US006769995B1

(12) United States Patent
Rhodes et al.

(10) Patent No.: US 6,769,995 B1
(45) Date of Patent: Aug. 3, 2004

(54) METHOD AND APPARATUS FOR IMPROVING A GOLFER'S PUTTING STROKE

(76) Inventors: Charles R. Rhodes, 130 Lorenzo Dr., Pleasant Hill, CA (US) 94523; Paul H. Warner, 1406 Santa Clara, Alameda, CA (US) 94501; Vincent J. Tringali, 2808 Buckingham Dr., Kelseyville, CA (US) 95451; Arthur J. Zanello, 15 Hidden Terrace, Hillsborough, CA (US) 94010; Daniel Burke, 78 parker, #4, San Francisco, CA (US) 94118

( * ) Notice: Subject to any disclaimer, the term of this patent is extended or adjusted under 35 U.S.C. 154(b) by 0 days.

(21) Appl. No.: 10/267,657

(22) Filed: Oct. 9, 2002

(51) Int. Cl.[7] ..... A63B 53/06; A63B 53/16; A63B 69/36; A63B 57/00

(52) U.S. Cl. ..... 473/265; 473/278

(58) Field of Search ..... 473/261, 264, 473/257, 260, 258, 265, 262

(56) References Cited

U.S. PATENT DOCUMENTS

| | | | | | |
|---|---|---|---|---|---|
| 2,992,005 | A | * | 7/1961 | Lockhart | 473/257 |
| 3,194,565 | A | * | 7/1965 | Schroer | 473/265 |
| 3,246,898 | A | | 4/1966 | Shoaf, Jr. | |
| 3,471,155 | A | | 10/1969 | Donaldson | |
| 3,572,720 | A | * | 3/1971 | Berg | 473/159 |
| 3,885,796 | A | | 5/1975 | King | |
| 4,423,875 | A | | 1/1984 | Miller | |
| 4,453,717 | A | * | 6/1984 | Solheim et al. | 473/265 |
| 4,596,391 | A | * | 6/1986 | Carolan, Jr. | 473/158 |
| 4,805,912 | A | | 2/1989 | Hickman | |
| 5,282,627 | A | | 2/1994 | Beck | |
| 5,332,211 | A | * | 7/1994 | Rife et al. | 473/258 |
| 5,362,057 | A | | 11/1994 | Arima | |
| 5,393,065 | A | * | 2/1995 | LeQuyea | 473/260 |
| 5,435,547 | A | * | 7/1995 | Lee | 473/225 |
| 5,437,458 | A | | 8/1995 | Springer | |
| 5,443,265 | A | * | 8/1995 | Wheeler | 473/257 |
| 5,467,992 | A | | 11/1995 | Harkness | |
| 5,527,041 | A | * | 6/1996 | Terry et al. | 473/150 |
| D380,518 | S | | 7/1997 | Barton et al. | |
| 5,797,804 | A | * | 8/1998 | Chen | 473/260 |
| 5,919,099 | A | | 7/1999 | Woods | |
| 6,019,685 | A | * | 2/2000 | Fonseca et al. | 473/265 |
| 6,159,106 | A | * | 12/2000 | Adams | 473/265 |

* cited by examiner

*Primary Examiner*—Stephen P. Garbe
*Assistant Examiner*—Alvin A. Hunter, Jr.
(74) *Attorney, Agent, or Firm*—James G O'Neill; Klein, O'Neill & Singh, LLP

(57) ABSTRACT

A putter guide device and method for improving the putting stroke of a golfer. The device includes a flat mat having an opening at one end and a pair of perpendicular lines forming a "T" intersection. A pair of guide walls are magnetically held on the flat mat to enable a golfer to stroke a putter along a horizontal line between the pair of guide walls to repeatedly and accurately hit a golf ball held in the opening with the putter sweet spot. The method includes the use of the teaching device first without the guide walls and a golf ball, then with one guide wall and a golf ball and then with both guide walls. The guide walls may be adjusted to allow more or less space for a putter head being stroked therebetween.

12 Claims, 1 Drawing Sheet

METHOD AND APPARATUS FOR IMPROVING A GOLFER'S PUTTING STROKE

BACKGROUND OF THE INVENTION

1. Field of the Invention

This invention relates generally to teaching aids, and more particularly, to a method and apparatus for improving the mechanics of a putting stroke of a golfer.

2. Description of Related Art

As is well known to golfers, the holding of a golf club, body alignment and stroke, together with club face alignment when hitting a golf ball are important in playing a good game of golf, and particularly, in putting. In this connection, numerous devices and methods have been adopted, and many patents obtained on devices and methods for improving golf strokes. Examples of such known devices and methods are set forth in the following U.S. Pat. Nos. 5,919,099 5,797,804 5,467,992 5,437,458 5,362,057 5,282,627 4,805,912 4,423,875 4,244,576 3,885,796 3,471,155 3,246,898 U.S. Des. Pat. No. 380,518

While the known devices and methods aid in allowing a golfer to improve their swing in some circumstances, the known devices and methods do not work for all golfers, nor do they provide the correct, continuous, repetitive motion necessary to create "muscle memory" required for consistent putter strokes.

Therefore, there exists a need in the art for an improved and simplified device and method that permits a golfer to improve their putter strokes, by teaching the proper placement and stroking of a putter, and the steps required for creating consistency of stroking the ball during the putting process.

SUMMARY OF THE INVENTION

Accordingly, it is a general object of the present invention to provide an improved and simplified training device for aiding a golfer in putting. It is a particular object of the present invention to provide an improved and simplified putter guide device for use in teaching good putting stroke technique. It is another particular object of the present invention to provide an improved putter guide device for placement on a surface in front of a golfer in a putting stance to aid the golfer to visualize and practice good putter strokes. It is yet another particular object of the present invention to provide an improved and simplified putter guide device for use in teaching proper golf putting technique. It is yet a further particular object of the present invention to provide an improved putter guide device having a pad and movable walls for guiding a putter. It is yet another particular object of the present invention to provide an improved golf putter guide device having a mat and movable walls, held to the mat by magnets to allow easy adjustability of the walls. And, it is a still further particular object of the present invention to provide a process to improve the consistency of a golfer's putting stroke, by allowing the golfer to practice and visualize putting strokes using a flat mat having an opening formed at one end and horizontal/perpendicular reference and guide lines marked thereon, with a pair of movable walls, whereby the golfer may practice putting so as to create good muscle memory and consistent putting strokes.

These and other objects of the present invention are achieved by providing a flat mat having an opening formed at one end and horizontal/perpendicular reference and guide lines thereon, as well as a pair of movable guide walls removably secured to the flat mat by magnetic means so that the walls may be incrementally adjusted to aid a golfer's putting technique. Also, the present invention involves the process of practicing putting using the flat mat alone and/or with either or both guide walls to create consistency in putting technique.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawing, in which:

DETAILED DESCRIPTION OF THE PREFERRED EMBODIMENT

Figure 1:
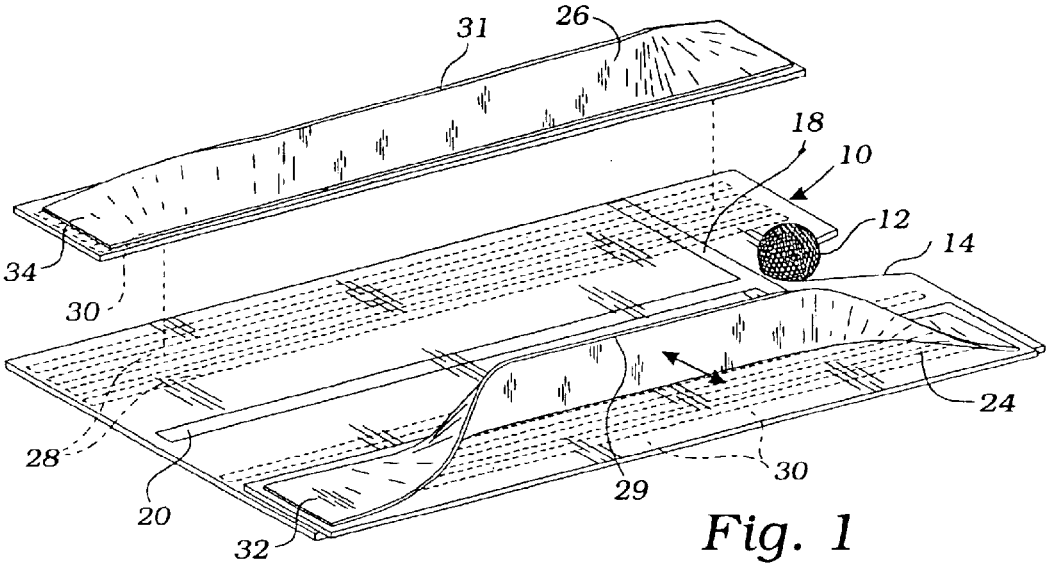
FIG. 1 is a partially exploded perspective view of a preferred embodiment of a putter guide device of the present invention.
Figure 2:
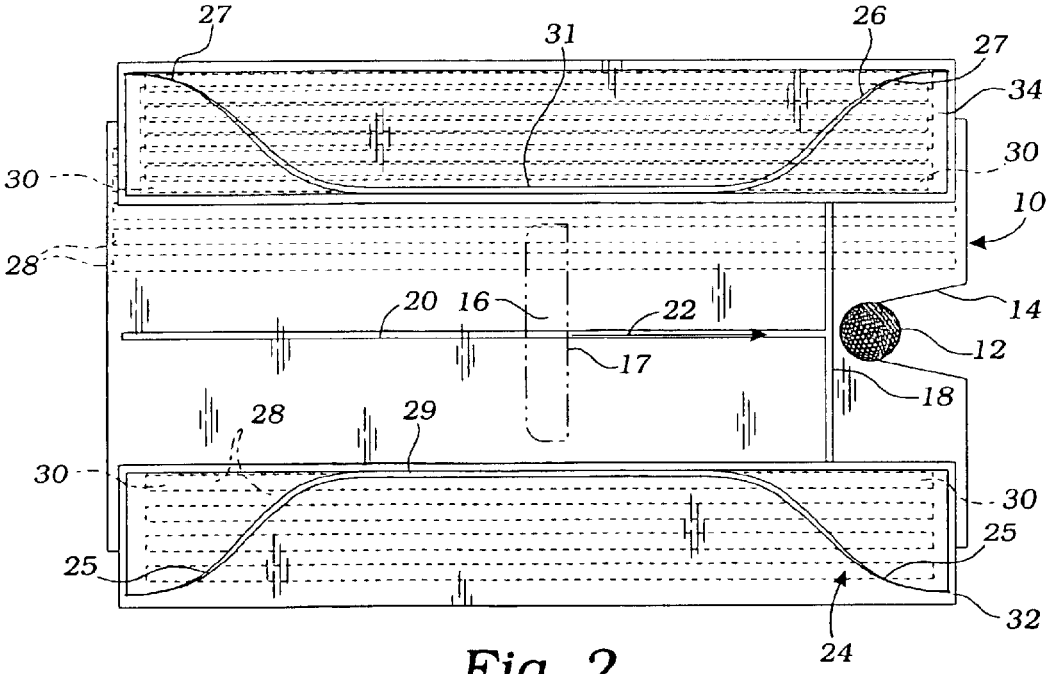
FIG. 2 is a top plan view of the device of FIG. 1.

The following description is provided to enable any person skilled in the art to make and use the invention, and sets forth the best modes contemplated by the inventors of carrying out their invention. Various modifications, however, will remain readily apparent to those skilled in the art, since the generic principles of the present invention have been defined herein, specifically to provide for an improved and simplified device and method for consistent putting strokes.

In putting, which represents about one-half the score of a golfer during a golf game, good muscle memory creates consistency in putting a golf ball. Therefore, the primary goal in good putting technique is for the golfer to consistently hit or stroke the ball. In pending application Ser. No. 09/723,954, filed on Nov. 27, 2000, applicants disclosed one type of device and method for improving a golfer's putting stroke. However, it has been found that the placement of the putter head and the alignment of the sweet spot on the putter face during the actual stroking of the golf ball are paramount to consistency in putting by having the ball repeatedly traveling the same distance and direction. The present invention helps to eliminate inconsistency in putting by teaching or training a golfer to use proper alignment of the sweet spot on the face of the putter head with the ball during a stroke so as to create muscle memory and teach stroke consistency.

The device of the present invention has a mat 10, which is preferably flat and may be flexible or rigid. The mat 10 is placed on a substantially flat surface, in any desired location, such as on a floor or on a putting green aimed at a hole. The mat 10 includes an opening 14 at one end. This opening 14 may be any desired size or shape, but is preferably funnel shaped, for receiving a ball 12 at an inner end thereof. This hole perfectly aligns ball to the centerline of the mat (20). A golfer, not shown, holding a putter having a head 16, assumes a normal putting stance in relation to the mat 10. If this stance is wrong, it is easy to correct in accordance with the method herein disclosed. The golfer then, if he or she has not already done so, finds the "sweet spot" on the face 17 of the head 16 of the putter, in a manner well known to those skilled in the art. A mark or spot is placed on the putter head 16 so as to be visible to the golfer in the normal putting stance. This mark indicates the sweet spot. The putter head 16, and particularly the face 17, are held so that the face is parallel to a vertical reference line 18 formed or marked on the mat 10, adjacent to the inner end of the opening 14. The sweet spot marked on the putter face 17 should be aligned with a further horizontal guide line 20 formed or marked on the mat, perpendicular to line 18, and forming a "T" intersection or junction therewith. This horizontal guide line 20 should pass through the center of the ball 12, if the ball is held in opening 14. The sweet spot on the putter face 17 is the only location where the same forward force of the putter, during a stroke, will produce a repeatable distance of travel of a golf ball, when the ball is struck. All other locations on the putter face 17 that strike the ball will produce different distances with the same forward force.

Once the golfer has correctly aligned the club head 16 and sweet spot on club face 17 with the lines 18, 20, the golfer takes a normal stroke with the putter, in the direction of arrow 22, toward the "T" intersection, and a hole, if there is one. This "T" intersection of lines 18, 20 would be the ideal location where the sweet spot would strike the ball 12, if the ball was held in the inner end of opening 14. The golfer should then repeat the putter stroke process over the mat 10, and concentrate on holding the putter head 16 aligned with or parallel to vertical reference line 18. The sweet spot marked on putter face 17 should also be aligned with horizontal guide line 20 and aimed or pointed at the "T" intersection of the two lines.

The golfer should continue practicing until he or she has successfully achieved the required skill in such a putting stroke. Then, at least one of a pair of guide walls 24, 26 is placed on one side of the flat mat 10, so as to be substantially parallel with the horizontal line 20. The side of the mat 10 on which the guide wall 24 or 26 is placed depends on whether the golfer is right or left-handed, or how the golfer puts.

The guide walls 24, 26 have curved or slanted entrance and exit portions 25, 27 that blend or merge into straight, substantially straight central portions 29, 31, to aid the golfer in practicing their putting.

The mat 10 and flat bottom portions 32, 34 of guide walls 24, 26 include a plurality of magnetic means 28, 30 embedded therein or secured thereto. The magnetic means 28, 30 may take any desired form or shape, such as strip, sheet or similar type magnets. The magnets 28, 30 are preferably located in parallel rows on the mat 10 and the flat bottom portions 32, 34. The magnets in each parallel row preferably have the same,polarity, which polarity is opposite that of the polarities of the magnets in adjacent rows, thereby providing rows of alternate polarities. The parallel rows of magnets 28, 30 are also placed in the device so as to be parallel to horizontal line 20 on the mat 10. In this manner, either or both guide walls can be incrementally moved so as to be exactly positioned with respect to each other, horizontal line 20 and the ball 12 when held at the inner end of the opening 14. When the guide walls 24, 26 are moved or placed on the mat 10 the parallel rows of magnets 30, 32, of opposite polarity will attract each other, while those of like polarity will repel each other. Therefore, when the walls are brought to the mat, lifted or moved, the like polarity rows of magnets will repel each other to allow the guide walls to be incrementally adjusted by jumping or moving to a row of opposite polarity, or a further alignment location parallel to line 20.

In one preferred embodiment of the device, the parallel rows of magnets 28, 30 are dimensionally close to each other, for example, approximately 0.125 inches apart to allow the guide walls 24, 26 to be moved in small increments, toward and away from each other and with respect to the horizontal line 20.

The selected guide wall 24 or 26 is preferably placed on the mat 10 any desired distance from the heel of the putter head 16, when the putter head is placed on vertical line 18, at the "T" intersection of the two lines 18, 20, with the putter face 17 parallel to the line 18. The ball 12 is placed in the inner end of opening 14, adjacent the "T"intersection of the perpendicular lines 18, 20. The golfer, who, through practice on the mat, has gained confidence in being able to move the sweet spot on the club face 17 over the "T" intersection of lines 18, 20, may now practice using the single guide wall 24 or 26 and the ball 12. During this practice, the golfer keeps the putter head parallel to the vertical line 18 and passes the sweet spot on the putter face 17 through the "T" intersection, to hit the ball 12, without hitting the guide wall. For example, depending on the golfer's skill, the heel of the putter head may be placed from about 0.125 inches to 0.375 inches from the single guide wall placed on the mat.

In another variation in training, the golfer continues to practice hitting the ball 12 using the mat 10 and single guide wall 24 or 26 until the golfer feels confident about stroking (putting) the ball 12, without hitting the single wall. The golfer can practice using both guide walls by positioning the putter on the mat 10 with the sweet spot mark on the putter head 16 positioned on line 20 on the mat. The golfer places walls 24 and 26 so as to be positioned substantially parallel to horizontal guide line 20 on mat 10. The positioning of each wall should be a comfortable distance from the heel and/or toe of the putter. The golfer repeats the putting stroke with the sloped portion of the guide walls guiding the putter head 16 into the parallel channel formed by the walls 24, 26. As the putting stroke becomes more consistent, indicated by not hitting the guide walls 24, 26 during the putting stroke, the channel is narrowed by moving the individual walls inwardly, toward the heel and toe of the putter head 16. This process of moving the walls closer to the heel and toe of the putter head 16 should be repeated until a minimal distance is reached with the putter head 16 consistently striking the ball with the putter sweet spot and without touching the walls during the putting stroke. The adjustable guide walls 24, 26 provide an adjustable channel having larger openings at each end and a restricted or narrow central portion having substantially parallel walls, so that the golfer will continue to create or gain muscle memory by repeating the process over a sufficient period of time, and/or by stroking the putter properly enough times to consistently hit the ball on the sweet spot.

As the golfer gains confidence, the golfer may move the walls 24, 26 closer together. The golfer should repeat the steps outlined above until the golfer feels comfortable that they are consistently hitting the ball with the sweet spot of the putter face, on a golf course during play of a game. Additionally, the golfer may practice, as needed, to maintain consistency in putting. During practice, the golfer will rest the putter 16 on the mat 10 with the putter face in close proximity to the vertical reference line 18. The golfer will adjust the grip on the putter or his stance so that the putter face 17 is visually parallel to the vertical reference line 18. The more parallel the putter face 17 is to the vertical reference line 18, the more accurately the ball will follow line 20 which is the desired direction of the path of the putt.

During practice, an additional method of training the golfer to determine the proper alignment of the putter face 17 to the vertical line 18 can be accomplished. Without using the mat 10, the golfer positions the putter 16 touching or very slightly behind the ball and slightly off the surface being used. This should be in a location that the golfer thinks the putter face 17 is aimed at the desired target or hole and would be perpendicular to the line of the putt (line 20 if the mat 10 was placed in position). With the aid of a second person, and without moving the putter, the mat 10, without guide walls, is slid in from behind the ball (direction illustrated by the arrow 22) under the putter head 16 and close to contacting the ball 12, as described above. Then the second person continues to adjust the mat by sighting down line 20 directly at the desired target or hole. When the mat 10 is properly positioned, it will become visually apparent to the golfer that the putter face 17 is or is not parallel to the vertical line 18 and small changes can be made to reposition the putter face 17 to be exactly parallel to line 18. This provides a very useful visualization training technique.

By using the method of the present invention the golfer improves the mechanics of their putter stroke by improving the golfer's ability to stroke the ball with the proper force and consistently striking the sweet spot on the putter face. By practicing with the mat 10 and walls 24, 26 the golfer will consistently hit the ball with the sweet spot on the putter face, thereby improving the golfer's putting stroke and overall golf game. Using the method of the present invention, the player heightens his or her sensitivity to the proper manner of holding a putter and striking a ball with the sweet spot on the putter face, thus improving the mechanics of their putting stroke. Finally, the method of the present invention improves a player's putting toward a hole on a golf course by allowing the golfer to visualize the sweet spot and its contact with a golf ball during a putting stroke.

Those skilled in the art will appreciate that there are adaptations and modifications of the just-described preferred embodiments that can be configured without departing from the scope and spirit of the invention. Therefore, it is to be understood, that within the scope of the intended claims, the invention may be practiced other than is specifically described herein.

What is claimed is:

1. A device for aiding a golfer in improving a putter stroke, comprising:

a flat mat having an opening for receiving a golf ball formed at one end;

perpendicular lines on a top surface of the flat mat forming a "T" intersection;

the opening in the flat mat having an inner end adjacent the "T" intersection:

a pair of guide walls removably mounted on the flat mat;

a plurality of rows of magnets holding the pair of guide walls to the flat mat; and the pair of guide walls including sloped outer ends and straight inner portions for forming an adjustable channel through which a putter head may pass.

2. The device of claim 1 wherein the plurality of rows of magnets are secured in the mat and in bottom flat portions of the pair of guide walls.

3. The device of claim 2 wherein the plurality of rows of magnets alternate in polarity to allow the pair of guide walls to be adjusted in predetermined increments.

4. The device of claim 3 wherein each magnet in the plurality of rows of magnets is a strip magnet.

5. A device for aiding a golfer in improving a putter stroke, comprising:

a flat mat having an opening for receiving a golf ball formed at one end;

a pair of guide walls removably mounted on the flat mat; each of the pair of guide walls having a bottom flat portion for supporting each of the pair of guide walls on the flat mat, and which guide walls are shaped to guide a putter head to a proper location;

magnetic means holding the pair of guide walls to the flat mat; and the pair of guide walls including sloped outer ends and straight inner portions for forming an adjustable channel through which a putter head may pass.

6. The device of claim 5 wherein the magnetic means is a plurality of alternating polarity rows of strip magnets held in the flat mat and the bottom flat portion of each of the pair of guide walls.

7. The device of claim 6 further including perpendicular lines formed on a top surface of the flat mat; the perpendicular lines forming a "T" intersection behind an inner end of the opening in the mat.

8. The device of claim 7 wherein the plurality of alternating polarity rows of strip magnets are spaced about 0.125 inches apart.

9. A device for aiding a golfer in improving a putter stroke, comprising:

a flat mat having a bottom surface, a top surface, two sides and two ends;

an opening for receiving a golf ball formed in one of the two ends and extending between the bottom surface and the top surface;

a pair of perpendicular lines on the top surface forming a "T" intersection adjacent to an inner end of the opening with one of the pair of perpendicular lines aligned with the inner end;

a pair of guide walls removably supported on the flat, flexible mat;

the pair of guide walls including angled outer ends and straight central portions, which straight central portions are substantially parallel to the one of the pair of perpendicular lines; and a plurality of magnets holding the pair of guide walls on the flat mat; the plurality of magnets being strip magnets arranged in a plurality of parallel rows, with each of the plurality of parallel rows containing strip magnets that are of opposite polarity to adjacent rows.

10. The device of claim 9 wherein the pair of guide walls include flat bottom portions having some of the plurality of parallel rows of strip magnets held therein.

11. The device of claim 10 wherein the plurality of parallel rows of strip magnets are spaced apart approximately 0.125 inches.

12. The device of claim 11 wherein the flat mat is flexible and the pair of guide walls form a channel to guide a head of a putter being stroked through the channel.

* * * * *